US006630424B2

(12) United States Patent
Gotoh et al.

(10) Patent No.: US 6,630,424 B2
(45) Date of Patent: Oct. 7, 2003

(54) THERMOSENSITIVE RECORDING MATERIAL, BLOCK COPY SHEET USING THE RECORDING MATERIAL AND PRINTING PLATE PREPARED BY USING THE BLOCK COPY SHEET

(75) Inventors: Hiroshi Gotoh, Fuji (JP); Chiaki Uematsu, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 09/738,638

(22) Filed: Dec. 15, 2000

(65) Prior Publication Data

US 2001/0018403 A1 Aug. 30, 2001

(30) Foreign Application Priority Data

Dec. 17, 1999 (JP) ..... 11-359875

(51) Int. Cl.[7] ..... B41M 5/40
(52) U.S. Cl. ..... 503/201; 503/200; 503/226
(58) Field of Search ..... 503/200, 226, 503/201

(56) References Cited

U.S. PATENT DOCUMENTS

| | | | | |
|---|---|---|---|---|
| 5,024,986 A | * | 6/1991 | Katsura et al. | 503/200 |
| 5,380,693 A | | 1/1995 | Goto | 503/200 |
| 5,521,138 A | | 5/1996 | Shimada et al. | 503/209 |
| 5,532,201 A | | 7/1996 | Goto | 503/213 |
| 5,712,221 A | | 1/1998 | Goto et al. | 503/226 |
| 5,739,077 A | | 4/1998 | Goto et al. | 503/200 |
| 5,741,752 A | | 4/1998 | Goto et al. | 503/221 |

FOREIGN PATENT DOCUMENTS

| | | |
|---|---|---|
| JP | 10166737 | 6/1998 |

OTHER PUBLICATIONS

U.S. patent application Ser. No. 09/179,514, Grotoh, filed Oct. 27, 1998.

U.S. patent application Ser. No. 08/355,903, Goto et al., filed Dec. 14, 1994.

U.S. patent application Ser. No. 08/070,859, filed Jun. 3, 1993.

* cited by examiner

*Primary Examiner*—B. Hamilton Hess
(74) *Attorney, Agent, or Firm*—Cooper & Dunham LLP

(57) ABSTRACT

A roll-shaped thermosensitive recording material having a thermosensitive recording layer, which includes as main components an electron donating coloring agent, an electron accepting color developer and a binder resin and which is formed overlying a substrate, wherein the roll-shaped thermosensitive recording material has a variation (R) of thickness of in the lateral direction of not greater than 3 $\mu$m. Alternatively, the roll-shaped thermosensitive recording material has a difference in thickness between the left side and the right side in the lateral direction of not greater than 0.7 $\mu$m.

20 Claims, 5 Drawing Sheets

THERMOSENSITIVE RECORDING MATERIAL, BLOCK COPY SHEET USING THE RECORDING MATERIAL AND PRINTING PLATE PREPARED BY USING THE BLOCK COPY SHEET

BACKGROUND OF THE INVENTION

1. Field of the Invention

The present invention relates to a thermosensitive recording material for plate-making use which is useful as a block copy for making a printing plate for flexography, gravure printing, offset printing, and screen printing. In addition, the present invention relates to a thermosensitive recording material useful as a recording material for computer-aided design (CAD). Further the present invention relates to a block copy sheet for making a printing plate, and a printing plate prepared by using the block copy sheet.

2. Discussion of the Background

Thermosensitive recording materials are widely known which utilize a coloring reaction between an electron donating coloring compound (hereinafter sometimes referred to as a coloring agent) and an electron accepting compound (hereinafter sometimes referred to as a color developer). In recent years, the thermosensitive recording materials are used for various uses, and needs exist for thermosensitive recording materials which can be used as second original sheets or plans for diazo copying. In addition, needs exist for thermosensitive recording materials which can be used as a block copy film for making a plate useful for flexography, gravure printing, offset printing, and screen printing.

In general, the characteristics requisite for the thermosensitive recording materials are as follows:

1) recorded images formed therein have high contrast between image areas and background areas (good image recognizability);
2) recorded images have good light shielding properties and background areas have good light transmitting properties against an ultraviolet wavelength region (360 nm–420 nm) so as to be used as a block copy film for plate-making use;
3) the thermosensitive recording sheets or films and recorded images have good preservation stability even when preserved under various environmental conditions such as high temperatures and high humidity, and good light resistance;
4) recorded images can be easily checked when determining whether there are deviation and mistakes in the images while several block copy films for plate-making use are overlaid each other (good drawing-checking ability);
5) recorded images have good dimensional accuracy;
6) recorded images have good resolution; and
7) the thermosensitive recording films have good head-matching properties when images are recorded with a thermal head.

A thermosensitive recording material having such requisite properties is proposed in Japanese Laid-Open Patent Publication No. 8-118811. However, when a block copy film is prepared for plate-making uses, there is a case in which high levels of inter-plates accuracy between block copy films (this accuracy is sometimes referred to as inter-plate error) and skew are required. Therefore problems concerning the inter-plates accuracy and skew occur when the above-proposed thermosensitive recording material is used as the block copy. As shown in FIG. 1, the term "inter-plates accuracy" is defined as the length difference, (La-Lc) and (Lb-Ld), and the term "skew" is defined as the length difference (La-Lb) and (Lc-Ld).

With respect to the above-mentioned problems concerning the inter-plates accuracy and skew, the dimensional accuracy of recorded images formed in a block copy film depends on the conditions under which the block copy film is prepared and the printing conditions under which the formed block copy film is used for printing. When a block copy film is prepared using a block copy forming apparatus, the block copy forming apparatus also has influence on the dimensional accuracy of the block copy film, which are as result-effecting as or more result-effecting than the influence that the film has on the dimensional accuracy. For example, the accuracy of film-feeding and the dimensional accuracy of heating elements of a print head such as thermal heads have influence on the dimensional accuracy of the resultant images.

The accuracy of film-feeding is influenced by:

(1) uneven feeding which is caused by the friction between the surface of the film and a thermal head serving as a print head, fusion of the film to the thermal head (a so-called sticking phenomenon, i.e., a phenomenon in which the surface of a recording material is softened or fused by the heat of a thermal head and sticks to the thermal head), and head-dust adhered to the thermal head due to the fusion of the film (so-called head-dust adhesion);
(2) simple mechanical feeding accuracy of the film fed by an image forming apparatus, which is caused by changes of environmental conditions and inner temperature of the image forming apparatus; and
(3) simple physical expansion and contraction of the film caused by changes of environmental conditions and inner temperature of the image forming apparatus.

The sticking phenomenon and the head-dust adhesion caused by fusing-adhesion largely depend on the protective layer (or the overcoat layer) and the recording layer. Even when only the lubricating property of the protective layer is enhanced and the film of the protective layer is hardened, if the recording layer is a layer which softens and is crushed upon application of heat, the recording layer becomes the cause of the sticking phenomenon and the head-dust adhesion caused by the fusion of the film.

In addition, changes in feeding quantity due to changes of environmental conditions and the temperature inside the apparatus, and expansion and contraction of the film due to the temperature change are a factor of the feeding accuracy. Further, changes in tension when a roll-shaped film is fed out, which is caused by charging of the roll film and changes of the diameter of the roll, are a factor of the feeding accuracy.

There is a technique, which is disclosed in Japanese Laid-Open Patent Publication 10-166737, for improving the above-mentioned problems. However, even when this technique is used, there occurs a problem in the dimensional accuracy, which is caused by reasons other than the above-mentioned reasons.

Because of these reasons, a need exists for a thermosensitive recording material which utilizes a color reaction between an electron donating coloring compound and an electron accepting compound and which can solve the problems which have been experienced in the past.

SUMMARY OF THE INVENTION

Accordingly an object of the present invention is to provide a thermosensitive recording material which utilizes a color reaction between an electron donating coloring compound and an electron accepting compound and which can produce high levels of inter-plates accuracy between block copy films for plate-making use and skew.

Another object of the present invention is to provide a block copy sheet capable of making a good printing plate.

Yet another object of the present invention is to provide a printing plate for flexography, gravure printing, offset printing, and screen printing, which can produce good print images.

To achieve such objects, the present invention contemplates the provision of a roll-shaped thermosensitive recording material having a thermosensitive recording layer, which includes an electron donating coloring compound, an electron accepting compound and a binder resin and which is formed overlying a roll-shaped substrate, wherein the variation (R) of thickness of the roll-shaped thermosensitive recording material in the lateral direction is not greater than 3 $\mu$m.

The term roll-shaped recording material means a flat strip of recording material which is rolled up.

In another aspect of the present invention, a roll-shaped thermosensitive recording material is provided in which a thermosensitive recording layer including as main components an electron donating coloring compound, an electron accepting compound and a binder resin is formed overlying a substrate and in which the difference (inclination) in thickness between the right side and the left side thereof is not greater than 0.7 $\mu$m.

The thermosensitive recording material of the present invention may have an overcoat layer, which is formed overlying the thermosensitive recording layer and which includes as a main component a resin having almost the same refractive index as the binder resin included in the thermosensitive recording layer.

The variation (R) of thickness of the roll-shaped substrate in the lateral direction is preferably not greater than 4 $\mu$m, and the difference (inclination) in thickness between the right side and the left side of the roll-shaped substrate in the lateral direction is preferably not greater than 0.6 $\mu$m.

The thermosensitive recording material of the present invention, in which images are recorded upon application of heat or the like, is preferably used as a block copy for making a plate for flexography, gravure printing, offset printing, and screen printing.

These and other objects, features and advantages of the present invention will become apparent upon application of the following description of the preferred embodiments of the present invention taken into conjunction with the accompanying drawings.

DETAILED DESCRIPTION OF THE INVENTION

Figure 5:
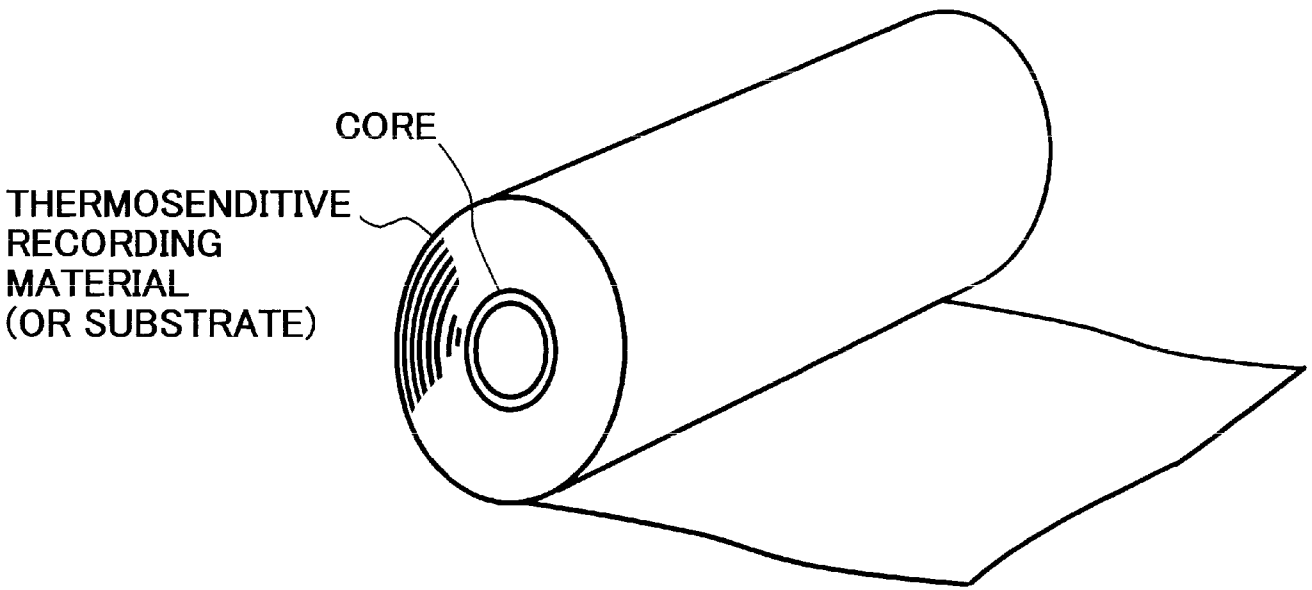
FIG. 5 is a schematic view illustrating a roll-shaped thermosensitive recording material or transparent substrate.

As shown in FIG. 5, the term "roll-shaped thermosensitive recording material (or transparent substrate) means a flat strip of recording material (or transparent substrate) which is rolled up. The core is not necessarily needed.

The inter-plates accuracy requisite for the block copy films for plate-making use is preferably not greater than ±0.1 mm/A0 size. As described below, the inter-plates accuracy is determined by comparing a block copy film having a print ratio of 70% with a block copy film having a print ratio of 30%. The skew is preferably not greater than ±0.2 mm/A0 size. As described below, the skew is defined as a difference between the left side and the right side of a block copy film. When a thermal head is used as a print head (heat source) for recording images, the factors for the inter-plates accuracy and skew in the side of the thermosensitive recording material used are as follows:

(1) the variation (R) of the thickness of the thermosensitive recording material in the lateral direction;

(2) the difference of thickness between the left side and the right side of the thermosensitive recording material in the lateral direction (inclination); and (3) expansion and contraction of the recording material due to changes of environmental conditions and the temperature inside the apparatus, and charging of the recording material which are caused by friction and fusion between the surface of the films and the thermal head.

In particular, in order to obtain a thermosensitive recording material having high levels of inter-plates accuracy and skew, the most important factors are the variation (R) of thickness of the recording material in the lateral direction and the difference (inclination) in thickness between the left side and the right side of the recording material in the lateral direction.

Figure 1:
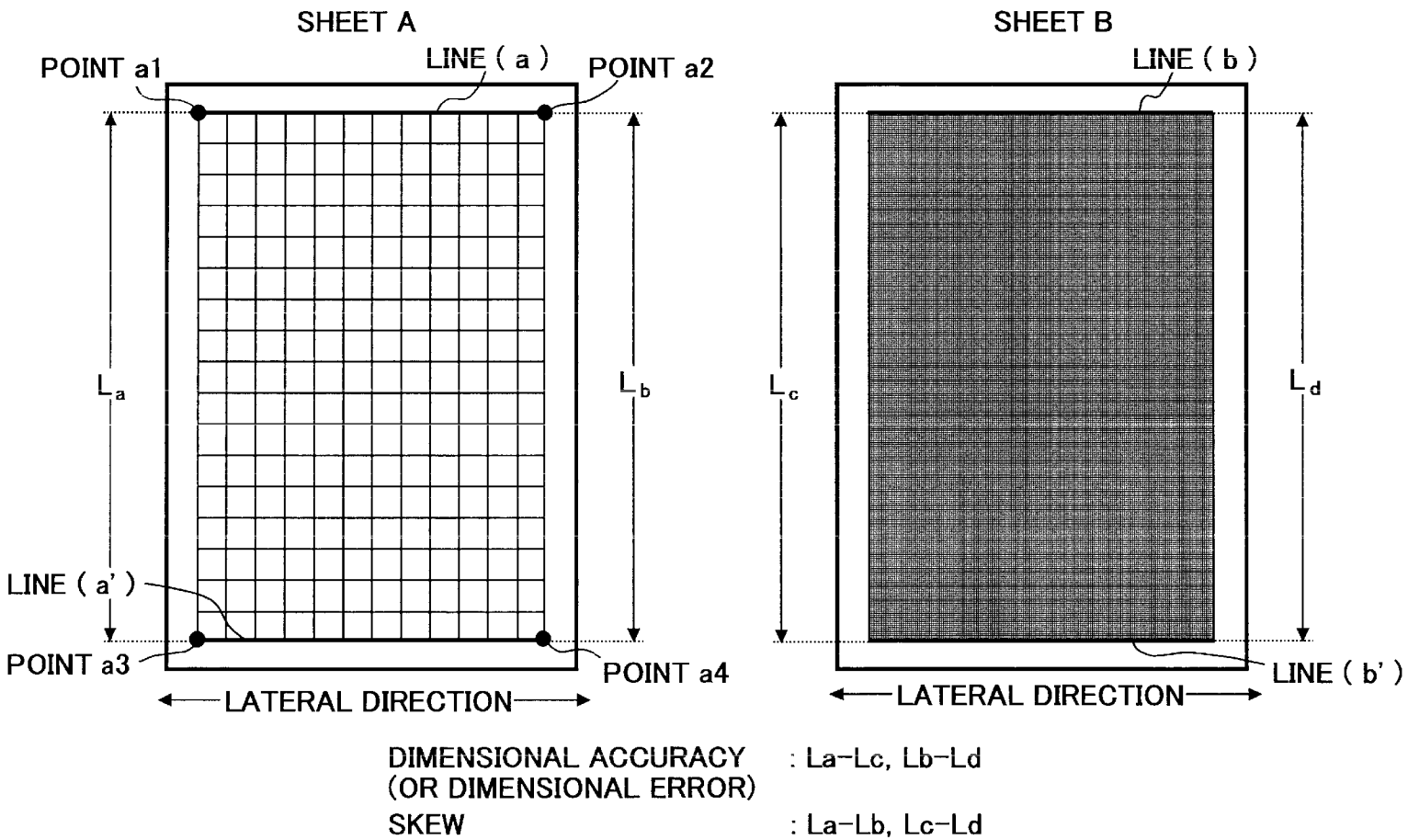
FIG. 1 is schematic views of block copy films used for defining the inter-plate accuracy and skew.

In the present invention, the inter-plates accuracy is determined as follows:

(1) an image is recorded on a thermosensitive recording material using a large-size plotter exclusively used as a trace station, TP-6910 (manufactured by Ricoh Co., Ltd.), such that three sheets of A0 size having a print ratio of 30% and three sheets of A0 size having a print ratio of 70% are formed;

(2) then one of the film having a print ratio of 30% (a sheet A in FIG. 1) and one of the film having a print ratio of 70% (a sheet B in FIG. 1) is overlaid such that a line (a) of sheet A is overlapped with a line (b) of sheet B, to determine using a magnifying glass having a scale manufactured by PEAK Co., Ltd. how a line (a') and a line (b') in FIG. 1 deviate from each other; and (3) this measurement is performed with respect to three pairs of the films having a print ratio of 30% and a print ratio of 70% to obtain an average value of the inter-plate accuracy.

Figure 2:
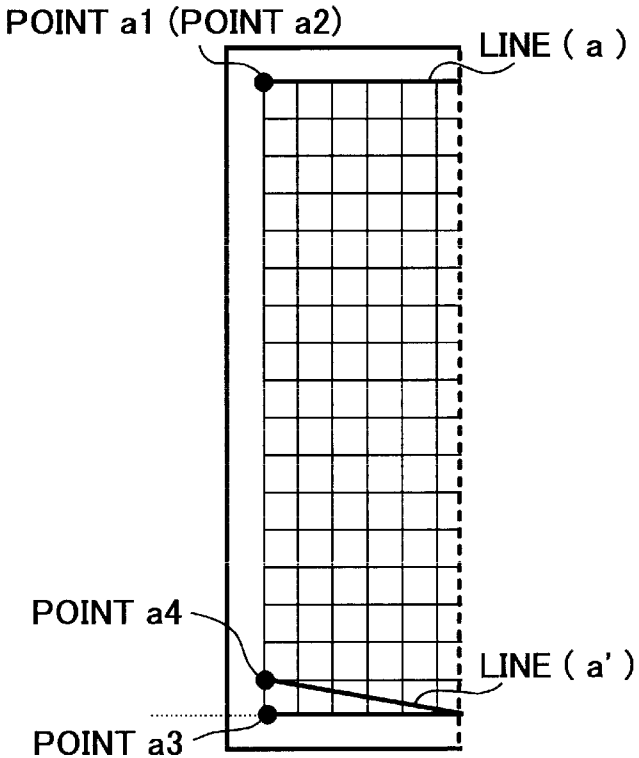
FIG. 2 is a schematic view illustrating how skew of a block copy film is measured in the present invention.

In addition, the skew is determined as follows:

(1) an image is recorded on a thermosensitive recording material using a large-size plotter TP-6910 such that one sheet of A0 size having a print ratio of 30% and one sheet of A0 size having a print ratio of 70% are formed;

(2) a film having a print ratio of 30% (sheet A in FIG. 1) is folded in two such that a point a1 is overlapped with a point a2, as shown in FIG. 2;

(3) the deviation of a point a3 from a point a4 is measured with a magnifying glass having a scale manufactured by PEAK Co., Ltd. to determine the skew of the sheet having a print ratio of 30%; and (4) this measurement is also performed with respect to the film having a print ratio of 70% to obtain an average value of the skew of the film.

In the present invention, the variation (R) of thickness of a roll-shaped recording material (or a roll-shaped substrate) in the lateral direction and the difference of thickness between the left side and right side thereof in the lateral direction are defined as follows:

1) variation (R) of thickness in the lateral direction

Figure 3:
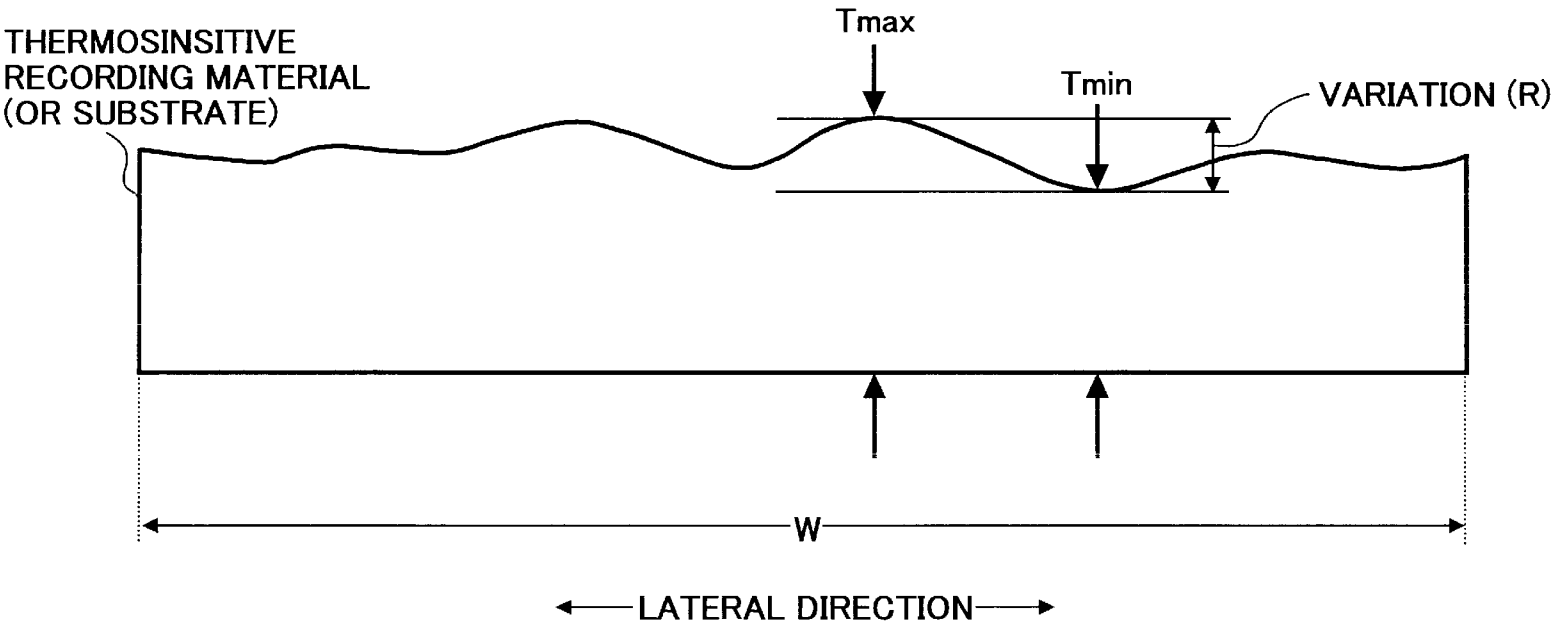
FIG. 3 is a schematic view of a cross section of a thermosensitive recording material or a transparent substrate used for determining the variation (R) of thickness in the lateral direction thereof.

The thickness of a roll-shaped thermosensitive recording material (or a substrate) in the lateral direction is measured with a contact type thickness gauge, Electronic Micrometer K351C manufactured by Anritsu Corp (measuring range of 0.1 $\mu$m), as shown in FIG. 3. The thickness is measured with respect to the measuring points as determined by the following equation 1. Thus the variation (R) of thickness thereof is obtained according to equation 2.

The number of measuring points=W mm/10 mm Equation 1 wherein W represents the width in the lateral direction of the recording material (or the substrate) used. The measuring conditions are 20±10° C. in temperature and 50±20% RH in relative humidity.

With respect to the measuring points, measurements are performed at equal intervals.

The variation (R) of thickness=Maximum thickness (Tmax)−Minimum thickness (Tmin) Equation 2

Figure 4:
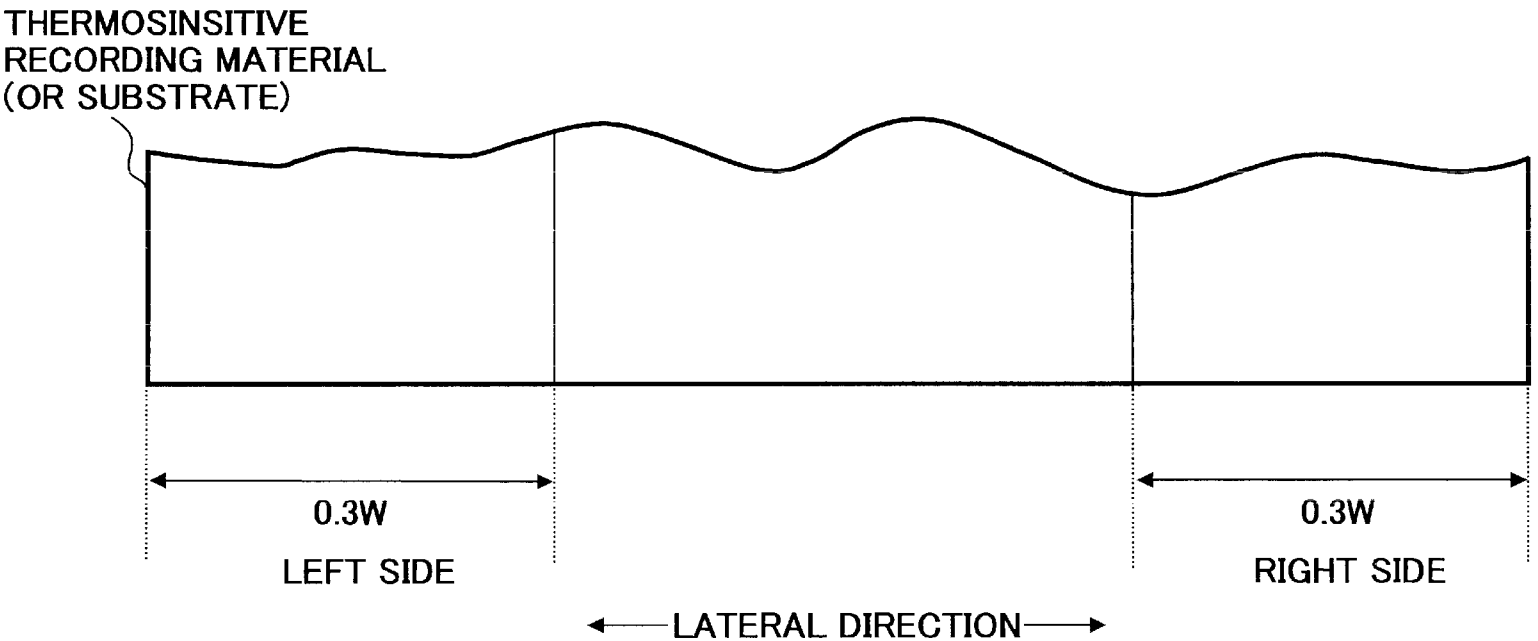
FIG. 4 is a schematic view of a cross section of a thermosensitive recording material or a transparent substrate used for determining the difference in thickness between the left side and the right side thereof in the lateral direction.

2) Difference in thickness between the left side and right side in the lateral direction As shown in FIG. 4, the thickness of a left side part and a right side part of a roll-shaped thermosensitive recording material (or a substrate) in the lateral direction, each of whose length from the left edge or the right edge is 30% of the width, respectively, is measured with a contact type thickness gauge, Electronic Micrometer K351C (measuring range of 0.1 $\mu$m) manufactured by Anritsu Corp. The thickness is measured with respect to the measuring points as determined by the following equation 3, and the difference of thickness between the left side and the right side is obtained by equation 4.

The number of measuring points in each of the left side part and the right side part=0.3 W mm/10 mm Equation 3 wherein W represents the width in the lateral direction of the recording material (or the substrate) used.

With respect to the measuring points, measurements are performed at equal intervals.

Difference of thickness between the left side part and the right side part=|(Average thickness of the left side part)−(Average thickness of the right side part)| Equation 4

In the present invention, it is discovered that the inter-plates accuracy and skew can be dramatically improved by imparting the variation (R) of thickness in the lateral direction of not greater than 3 $\mu$m to the roll-shaped thermosensitive recording material, or by imparting the difference in thickness between the left side and the right side in the lateral direction of not greater than 0.7 $\mu$m to the roll-shaped thermosensitive recording material, and thereby high level needs in of inter-plates accuracy and skew can be satisfied.

In addition, it is discovered that such a roll-shaped thermosensitive recording material mentioned above can be easily manufactured by imparting the variation (R) of thickness in the lateral direction of not greater than 4 $\mu$m to the roll-shaped transparent substrate, or imparting the difference of thickness between the left side and the right side in the lateral direction of not greater than 0.6 $\mu$m to the roll-shaped transparent substrate.

Suitable electron donating coloring compounds for use in the thermosensitive recording layer of the thermosensitive recording material of the present invention include dye precursors, which are colorless or pale-colored themselves, but are not specifically limited. For example, known fluoran compounds can be used as the coloring compounds. Specific examples the fluoran compounds include:

3-diethylamino-7-anilinofluoran, 3-di-n-butylamino-7-anilinofluoran, 3-(N-n-hexyl-ethylamino)-7-anilinofluoran, 3-diethylamino-7-dibenzylaminofluoran, 3-diethylamino-5-methyl-7-dibenzylaminofluoran, 3-diethylamino-7-piperidinofluoran, 3-diethylamino-7-(o-chloroanilino)fluoran, 3-di-n-butylamino-7-(o-chloroanilino)fluoran, 3-dimethylamino-6-methyl-7-anilinofluoran, 3-diethylamino-6-methyl-7-anilinofluoran, 3-di-n-butylamino-6-methyl-7-anilinofluoran, 3-(N-n-propyl-N-methylamino)-6-methyl-7-anilinofluoran, 3-(N-isopropyl-N-methylamino)-6-methyl-7-anilinofluoran, 3-(N-n-butyl-N-ethylamino)-6-methyl-7-anilinofluoran, 3- (N-isobutyl-N-methylamino)-6-methyl-7-anilinofluoran, 3-(N-n-amyl-N-methylamino)-6-methyl-7-anilinofluoran, 3-(N-isoamyl-N-ethylamino)-6-methyl-7-anilinofluoran, 3-(N-cyclohexyl-N-methyl)-6-methyl-7-anilinofluoran, 3-(N-n-amyl-N-ethylamino)-6-methyl-7-anilinofluoran, 3-(N-p-tolyl-N-ethylamino)-6-methyl-7-anilinofluoran, 3-(N-2-ethoxypropyl-N-ethylamino)-6-methyl-7-anilinofluoran, 3-pyrrolidino-6-methyl-7-anilinofluoran, 3-(N-tetrahydrofurfuryl-N-ethylamino)-6-methyl-7-anilinofluoran, 3-diethylamino-7-(m-trifluoromethylanilino)fluoran, 3-diethylamino-6-methyl-7-(2',4'-dimethylanilino)fluoran, 3-diethylamino-6-chloro-7-anilinofluoran, 3-diethylamino-5-methyl-7-(á-phenylethylamino)fluoran, 3-(N-p-tolyl-N-ethylamino)-7-(á-phenylethylamino)fluoran, and the like.

In addition, fluoran compounds having the following formulas (III)-(VI) are more preferably used as the coloring agents in the present invention.

(III)

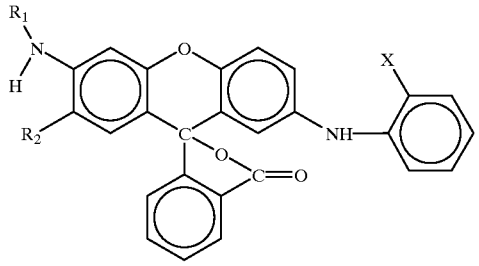

wherein R1 represents an alkyl group having not greater than 8 carbon atoms; R2 represents a hydrogen atom or an alkyl group having not greater than 4 carbon atoms; and X represents a halogen atom such as fluorine, chlorine, bromine or the like.

(IV)

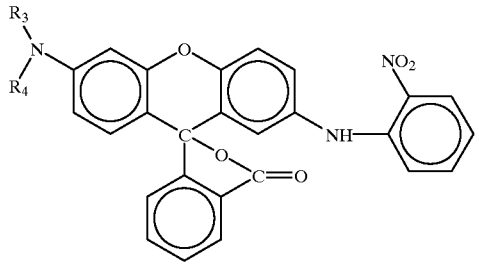

wherein R3 represents an alkyl group having not greater than 8 carbon atoms; and R4 represents an alkyl group having not greater than 8 carbon atoms.

(V)

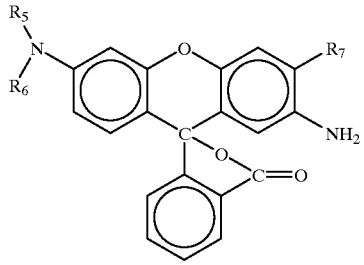

wherein R5 and R6 independently represent an alkyl group having not greater than 8 carbon atoms; and R7 represents a hydrogen atom, an alkyl group having one or two carbon atoms or an alkoxyl group having one or two carbon atoms.

(VI)

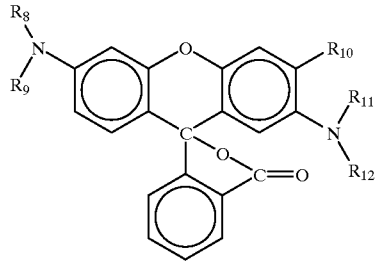

wherein R8 represents a hydrogen atom; R9 represents an alkyl group having not greater than 8 carbon atoms; R10 represents a hydrogen atom, an alkyl group having one or two carbon atoms or an alkoxyl group having one or two carbon atoms; R11 represents a hydrogen atom or an alkyl group having not greater than 8 carbon atoms; and R12 represents an alkyl group having not greater than 8 carbon atoms, a phenyl group or a substituted phenyl group.

(VII)

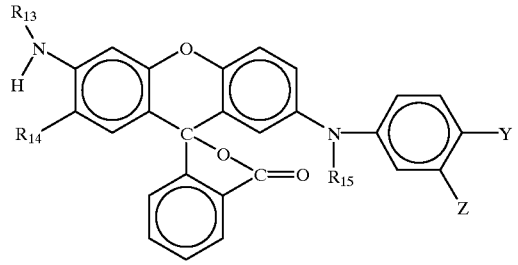

wherein R13 represents an alkyl group having not greater than 8 carbon atoms; R14 represents a methyl group or an ethyl group, R15 represents a hydrogen atom or an alkyl group having not greater than 4 carbon atoms; and Y and Z independently represent a hydrogen atom, or a halogen atom such as fluorine, chlorine, bromine or the like.

(VIII)

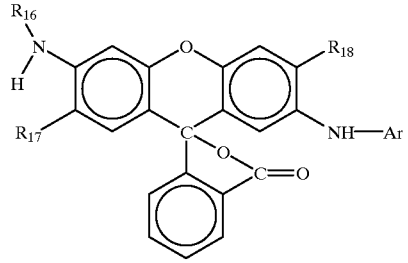

wherein R16 represents an alkyl group having not greater than 8 carbon atoms; R17 represents a methyl group or an ethyl group, R18 represents a hydrogen atom or an alkyl group having not greater than 4 carbon atoms; Y and Z independently represent a hydrogen atom, or a halogen atom such as fluorine, chlorine, bromine or the like; and Ar represents a phenyl group or a benzyl group.

Specific examples of the fluoran compounds having formula (III) include:

2-(o-chlorophenylamino)-6-ethylamino-7-methylfluoran,
2-(o-chlorophenylamino)-6-n-butylamino-7-methylfluoran,
2-(o-fluorophenylamino)-6-ethylamino-7-methylfluoran,
2-(o-chlorophenylamino)-6-n-butylaminofluoran,
2-(o-chlorophenylamino)-6-n-hexylaminofluoran, 2-(o-chlorophenylamino)-6-n-octylaminofluoran, 2-(o-fluorophenylamino)-6-isoamylaminofluoran, and 2-(o-fluorophenylamino)-6-n-octylaminofluoran.

Specific examples of the compounds having formula (IV) include:

2-(o-nitrophenylamino)-6-diethylaminofluoran, 2-(o-nitrophenylamino)-6-di-n-butylaminofluoran, 2-(o-nitrophenylamino)-6-(N-ethyl-N-n-butylamino) fluoran, and 2-(o-nitrophenylamino)-6-(N-ethyl-N-isoamylamino) fluoran.

Specific examples of the compounds having formula (V) include:

2-amino-6-diethylaminofluoran, 2-amino-6-di-n-butylaminofluoran, 2-amino-3-methyl-6-diethylaminofluoran, 2-amino-3-methyl-6-di-n-butylaminofluoran, 2-amino-3-methyl-6-(N-ethyl-N-isoamylamino)fluoran, 2-amino-3-methoxy-6-diethylaminofluoran, and 2-amino-3-methoxy-6-di-n-butylaminofluoran.

Specific examples of the compounds having formula (VI) include:

2-methylamino-6-n-butylaminofluoran, 2-n-butylamino-6-n-butylaminofluoran, 2-n-octylamino-6-ethylaminofluoran, 2-n-octylamino-3-methyl-6-n-butylaminofluoran, 2-phenylamino-6-ethylaminofluoran, 2-phenylamino-6-n-butylaminofluoran, 2-phenylamino-6-n-octylaminofluoran, 2-phenylamino-3-methyl-6-n-butylaminofluoran, 2-phenylamino-3-methyl-6-ethylaminofluoran, 2-phenylamino-3-methyl-6-n-hexylaminofluoran, 2-phenylamino-3-methyl-6-n-amylaminofluoran, 2-phenylamino-3-methyl-6-isoamylaminofluoran, 2-phenylamino-3-methyl-6-n-octylaminofluoran, 2-phenylamino-3-methoxy-6-n-butylaminofluoran, and 2-phenylamino-3-methoxy-6-n-hexylaminofluoran.

Specific examples of the compounds having formula (VII) include:

2-(3',4'-dichlorophenylamino)-6-ethylamino-7-methylfluoran, 2-(3',4'-dichlorophenylamino)-6-n-butylamino-7-methylfluoran, 2-(3'-chloro-4'-fluorophenylamino)-6-ethylamino-7-methylfluoran, 2-(N'-methyl-N-3'-chlorophenylamino)-6-ethylamino-7-methylfluoran, 2-(N-ethyl-N-3'-chlorophenylamino)-6-ethylamino-7-methylfluoran, and 2-(N-methyl-N-4'-chlorophenylamino)-6-ethylamino-7-methylfluoran.

Specific examples of the compounds having formula (VIII) include:

2-phenylamino-3-methyl-6-ethylamino-7-methylfluoran, 2-phenylamino-3-methyl-6-n-butylamino-7-methylfluoran, 2-phenylamino-3-ethyl-6-ethylamino-7-methylfluoran, 2-benzylamino-3-methyl-6-ethylamino-7-methylfluoran, 2-phenylamino-3-chloro-6-ethylamino-7-methylfluoran, 2-phenylamino-3-chloro-6-n-butylamino-7-methylfluoran, and 2-benzylamino-3-chloro-6-ethylamino-7-methylfluoran.

These coloring agents are used alone or in combination.

In the present invention, color developers, which make the above-mentioned coloring agents color, are preferably phenolic compounds and organic phosphoric acid compounds, which are preferably insoluble or hardly soluble in popular solvents. Specific examples of the phenolic compounds include gallic acid compounds, protocatechuic acid compounds, bis(hydroxyphenyl)acetic acid and the like. Specific examples of the organic phosphoric acid compounds include alkylphosphonic acid compounds, á-hydroxyalkylphosphonic acid and the like. Among these compounds, organic phosphoric compounds are superior in terms of thermosensitivity of the resultant recording material and background fouling of the resultant recorded images.

Among the organic phosphoric acid compounds, phosphonic acid compounds having the following formula (I) or (II) are even more preferable.

(I)

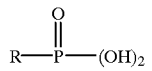

wherein R represents a linear alkyl group having from 16 to 24 carbon atoms.

(II)

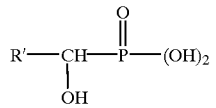

wherein R' represents a linear alkyl group having from 13 to 23 carbon atoms.

Specific examples of the phosphonic acid compounds represented by the above-mentioned formula (I) include hexadecyl phosphonic acid, octadecyl phosphonic acid, eicosyl phosphonic acid, docosyl phosphonic acid, tetracosyl phosphonic acid and the like.

Specific examples of the phosphonic acids represented by the above-mentioned formula (II) include á-hydroxytetradecyl phosphonic acid, á-hydroxyhexadecyl phosphonic acid, á-hydroxyoctadecyl phosphonic acid, á-hydroxyeicosyl phosphonic acid, á-hydroxytetracosyl phosphonic acid and the like.

In the present invention, the color developers are used alone or in combination.

In the present invention, the color developer for use in the thermosensitive recording layer preferably has an average particle diameter not greater than 10 $\mu$m, and more preferably has an average particle diameter of not greater than 1 $\mu$m and do not include particles having a diameter greater than 1 $\mu$m, to improve the thermosensitivity of the resultant thermosensitive recording material and the resolution of the resultant recorded images.

Binder resins for use in the thermosensitive recording layer are preferably materials which can stably maintain a colored dye material, which is produced by a ring-opening reaction caused by the attack of protons of the color developer on the above-mentioned coloring agent upon application of heat energy and the like, while allowing the color dye material to be in a condition rich with protons. In addition, materials which further allow the colored material to be in a condition in which the colored material hardly discolors are preferably used as the binder resin. For example, compounds which include a hydroxy group or a carboxylic acid group and which have a refractive index of from 1.45 to 1.60 at room temperature are preferable as the binder resin.

Specific examples of such a binder resin include polyvinyl butyral (1.48–1.49) , polyvinyl acetal (1.50), epoxy resins (1.55–1.61), ethyl cellulose (1.46–1.49), cellulose acetate (1.46–1.50) ,cellulose acetate butyrate (1.46–1.49), cellulose acetate propionate (1.46–1.49), nitro cellulose (1.49–1.51), styrene-maleic acid copolymers (1.50–1.60) and the like. The parenthesized values mean their refractive index. In addition, when acidic materials are included in binder resins as impurities, or ultraviolet absorbents, antioxidants, anti-aging agents and the like are included in the recording layer, a condition similar to the condition achieved by the above-mentioned binder resins can also be achieved.

Further, the resistance to light of the thermosensitive recording material in the present invention can be improved by including a photo-stabilizer in the thermosensitive recording layer or a protective layer (or an overcoat layer) which is formed on the recording layer. Ultraviolet absorbents, antioxidants, anti-aging agents, quenchers for oxygen in a singlet state, and quenchers for superoxide anions can be used as a photo-stabilizer.

Specific examples of the ultraviolet absorbents include benzophenone type ultraviolet absorbents such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2'-dihydroxy-4-methoxybenzophenone, 2,2'-dihydroxy-4,4'-dimethoxybenzophenone, 2,2',4,4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-5-chlorobenzophenone, 2-hydroxy-4-methoxy-4'-methylbenzophenone, 2-hydroxy-4-n-heptoxybenzophenone, 2-hydroxy-3,6-dichloro-4-methoxybenzophenone, 2-hydroxy-4-n-heptoxybenzophenone, 2-hydroxy-3,6-dichloro-4-ethoxybenzophenone, 2-hydroxy-4-(2-hydroxy-3-methylacryloxy)propoxybenzophenone and the like; benzotriazole type ultraviolet absorbents such as 2-(2'-hydroxy-5'-methylphenyl)benzotriazole, 2-(2'-hydroxy-3',5'-di-t-butylphenyl) benzotriazole, 2-(2'-hydroxy-3'-t-butyl-5'-methylphenyl)benzotriazole, 2-(2'-hydroxy-4'-octoxy) benzotriazole, 2-(2'-hydroxy-3',5'-di-t-butylphenyl)5-chlorobenzotriazole, 2-(3'-t-butyl-2'-hydroxy-5'-methylphenyl)5-chlorobenzotriazole, 2-(2'-hydroxy-5-ethoxyphenyl)benzotriazole and the like; salicylic acid phenyl ester type ultraviolet absorbents such as phenyl salicylate, p-octylphenyl salicylate, p-t-butylphenyl salicylate, carboxyphenyl salicylate, methylphenyl salicylate, dodecylphenyl salicylate and the like; p-methoxybenzylidenemalonic acid dimethyl ester, 2-ethylhexyl-2-cyano-3,3'-diphenylacrylate, ethyl-2-cyano-3,3'-diphenylacrylate, 3,5-di-t-butyl-p-hydroxybenzoate, resorcinolmonobenzoate which is rearranged to benzophenone by ultraviolet rays, 2,4-di-t-butylphenylbenzoate, 3,5-di-t-butyl-4-hydroxyphenylbenzoate, 3,5-di-t-butyl-4-hydroxybenzoate and the like.

Specific examples of the antioxidants and anti-aging agents include 2,6-di-t-butyl-4-methylphenol, 2,4,6-tri-t-butyl-4-phenol, styrenated phenol, 2,2'-methylenebis(4-methyl-6-t-butylphenol), 4,4'-isopropylidenebisphenol, 2,6-bis(2'-hydroxy-3'-t-butyl-5'-methylbenzyl)-4-methylphenol, 4,4'-thiobis-(3-methyl-6-t-butylphenol), tetrakis-{methylene(3,5-di-t-butyl-4-hydroxyhydrocinnamate)}methane, p-hydroxyphenyl-3-naphthylamine, 2,2,4-trimethyl-1,2-dihydroquinoline, thiobis(β-naphthol), mercaptobenzothiazole, mercaptobenzimidazole, aldol-2-naphthylamine, bis(2,2,6,6-tetramethyl-4-pyridyl)sebacate, 2,2,6,6-tetramethyl-4-piperidylbenzoate, dilauryl-3,3'-thiodipropionate, distearyl-3,3'-thiodipropionate, tris(4-nonylphenol)phosphite and the like.

Specific examples of the quenchers for oxygen in a singlet state include carotenes, dyes, amines, phenols, nickel complexes, sulfides and the like. For example, 1,4-diazabicyclo(2,2,2)octane, β-carotene, 1,3-cyclohexadiene, 2-diethylaminomethylfuran, 2-phenylaminomethylfuran, 9-diethylaminomethylanthracene, 5-diethylaminomethyl-6-phenyl-3,4-dihydroxypyran, nickeldimethyldithiocarbamate, nickeldibutyldithiocarbamate, nickel3,5-di-t-butyl-4-hydroxybenzyl-o-ethylphosphonate, nickel3,5-di-butyl-4-hydroxybenzyl-o-butylphosphonate, nickel{2,2'-thiobis(4-t-octylphenolate)}(n-butylamine), nickel{2,2'-thiobis(4-t-octylphenolate)}(2-n-butylamine), nickel{2,2'-thiobis(4-t-octylphenolate)}(2-ethylhexylamine), nickelbis(2,2'-thiobis(4-t-octylphenolate)}, nickelbis{2,2'-sulfonebis(4-octylphenolate)}, nickelbis(2-hydroxy-5-methoxyphenyl-N-n-butylaldoimine), nickelbis(dithiobenzyl), nickelbis(dithiobiacetyl) and the like.

Specific examples of the quenchers for superoxide anions, complexes of superoxide dismutase with cobalt [III] or nickel [II] and the like, but are not limited thereto in the present invention.

These photo-stabilizers are used alone or in combination.

In order to obtain a recording material having the high accuracy mentioned above, it is preferable that the recording layer is formed by coating a coating liquid by a high-precision rip coating machine. The variation (R) in thickness of the recording layer in the lateral direction is preferably not greater than 1.0 μm.

Suitable substrates for use in the thermosensitive recording material of the present invention include paper or a plastic film. The substrate is preferably transparent, and preferably has a refractive index of from 1.45 to 1.60 at room temperature.

Specific examples of the substrate include polyester films such as polyethyleneterephthalate, polybutyleneterephthalate and the like; cellulose derivative films such as triacetyl cellulose and the like; polyolefin films such as polypropylene, polyethylene and the like; polystyrene films; and transparent substrates in which two or more of these films are laminated.

In the present invention, it is preferable to form an adhesive layer between the thermosensitive recording layer and the substrate. Suitable materials for use in the adhesive layer include acrylic resins, saturated polyester resins and the like. In addition, crosslinked resins in which these resins are crosslinked can also be used for the adhesive layer.

In order to obtain a recording material having the high accuracy mentioned above, matching properties of the recording material with a thermal head can be improved by forming the following overcoat layer overlying the recording layer.

(1) A lubricating particulate organic filler (such as a particulate silicone resin) is added in an overcoat layer to impart the friction coefficient of not greater than 0.1 to the surface of the overcoat layer; and (2) The roughness of the surface of the overcoat layer is made so as to be a predetermined roughness (1–4 μm).

The friction between the surface of the film and a thermal head, fusing-adhesion (sticking phenomenon), head-dust adhesion caused by the fusing-adhesion and the like can be dramatically improved by the methods (1) and (2), resulting in improvement of the head-matching properties.

The overcoat layer of the recording material of the present invention is effective for the improvement of resistance to chemicals, resistance to water, abrasion resistance and light resistance as well as for the improvement of head-matching properties (i.e., for the improvement of dimensional accuracy). Therefore it is preferable to form the overcoat layer on the top of the thermosensitive recording material of the present invention.

Next, the overcoat layer of the present invention will be explained in detail.

Organic fillers for use in the thermosensitive recording material of the present invention preferably have a spherical shape and a 50% volume average particle diameter ($D_{50}$), which is obtained by an accumulated volume distribution of particles, of from 1 to 5 $\mu$m. In addition, organic fillers preferably have a linseed oil absorption not less than 50 ml/100 g. Further, organic fillers having lubricating properties such as silicone resins are more preferable. In order to enhance head-matching properties of the overcoat layer, it is preferable to use a combination of an inorganic filler having a 50% volume average particle diameter ($D_{50}$) of not greater than 0.7 $\mu$m with an organic filler having a 50% volume average particle diameter ($D_{50}$) of from 1 to 5 $\mu$m. The total content of the inorganic filler and the organic filler in the overcoat layer is preferably less than 50% in a solid weight ratio when cost, head-matching properties and other properties are taken into consideration.

Next, specific examples of the organic fillers and the inorganic fillers for use in the overcoat layer will be explained.

Organic fillers

Specific examples of the organic fillers include the following.

(1) PMMA type fine particles MP type, and MX type fillers, manufactured by Sohken Chemical Co., Ltd., and Technopolymer MB series.

(2) Silicone resin type fine particles

Torefill series manufactured by Dow Corning Toray Silicone Co., Ltd., and Tospearl series manufactured by Toshiba Silicone Co., Ltd.

Inorganic filler

Specific examples of the inorganic fillers include kaolin, calcined kaolin, calcined clay, talc, calcium carbonate, titanium oxide, zinc oxide, silica, colloidal silica, magnesium carbonate, magnesium oxide, aluminum hydroxide, and zinc hydroxide.

Resins, which have the same refractive index as the binder resin constituting the thermosensitive recording layer, are preferably used as a resin constituting the overcoat layer.

At this point, the term of the same refractive index means that the refractive index of the resin constituting the overcoat layer is substantially the same as that of the resin constituting the recording layer. When the refractive index of a resin in the overcoat layer is within the range of about ±5% of that of the resin in the recording layer, the refractive indexes of the resin is considered to be the same in the present invention. The refractive index of the resin in the overcoat layer is preferably from 1.45 to 1.60 at room temperature.

Suitable resins for use in the overcoat layer include water-soluble resin, aqueous emulsions, hydrophobic resins, ultraviolet crosslinking resins, electron beam crosslinking resins and resins to which a silicone segment is connected like a block or a graft. Specific examples of the water-soluble resins include polyvinyl alcohols, modified polyvinyl alcohols, cellulose derivatives (methyl cellulose, methoxy cellulose, hydroxyethyl cellulose, and the like), casein, gelatin, polyvinyl pyrrolidone, styrene-maleic anhydride copolymers, diisobutylene-maleic anhydride copolymers, polyacrylamide, modified polyacrylamide, methyl vinyl ether-maleic anhydride copolymers, carboxyl-modified polyethylene, polyvinyl alcohol/acrylamide block copolymers, melamine-formaldehyde resins, urea-formaldehyde resins and the like. Specific examples of the aqueous emulsions and the hydrophobic resins include polyvinyl acetate, polyurethanes, styrene/butadiene copolymers, styrene/butadiene/acryl type copolymers, polyacrylic acid, polyacrylic acid esters, vinyl chloride/vinyl acetate copolymers, polybutyl methacrylate, ethylene/vinyl acetate copolymers, and the like. These are used alone or in combination. If desired, a hardener may be added to crosslink the resins.

Then ultraviolet crosslinking resins, electron beam crosslinking resins, and resins to which a silicone segment is connected like a block or a graft, which are most preferable as the overcoat layer of the present invention, will be explained in detail.

Suitable ultraviolet crosslinking resins for use in the overcoat layer include any known monomers, oligomers or prepolymers, which can induce a polymerization reaction upon application of ultraviolet rays. Specific examples of such monomers, oligomers or prepolymers include (poly) ester acrylate, (poly)urethane acrylate, epoxy acrylate, polybutadiene acrylate, silicone acrylate, melamine acrylate and the like. (Poly)Ester acrylate includes a reaction product in which a polyhydric alcohol such as 1,6-hexane diol, propylene glycol (used as propylene oxide), diethylene glycol and the like is reacted with a polybasic acid such as adipic acid, phthalic anhydride, trimellitic acid and the like, and is then reacted with acrylic acid. Specific examples of the monomers, oligomers and prepolymers are shown in (a)-(c).

(a) Adipic acid/1,6-hexanediol/acrylic acid compounds $$CH_2{=}CH{-}COO{-}(CH_2)_6{+}O{-}CO{-}(CH_2)_4COO(CH_2)_6{+}_nOCOCH{=}CH_2$$

wherein n is an integer of from 1 to 10.

(b) Phthalic anhydride/propylene oxide/acrylic acid compounds

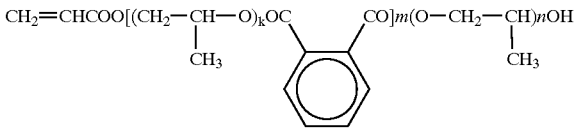

wherein k is an integer of from 1 to 10, m is an integer of from 1 to 10 and n is an integer of from 1 to 10.

(c) Trimellitic acid/diethylene glycol/acrylic acid compounds

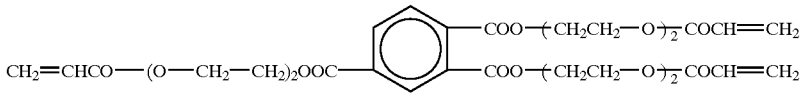

(Poly)Urethane acrylate is a reaction product of a compound having an isocyanate group such as tolylene diisocyanate (TDI) with an acrylate having a hydroxy group. An example of the structure is shown in (d). At this point, HEA represents 2-hydroxyethyl acrylate, HDO represents 1,6-hexanediol, and ADA represents adipic acid.

(d) HEA/TDI/HDO/ADA/HDO/TDI/HEA

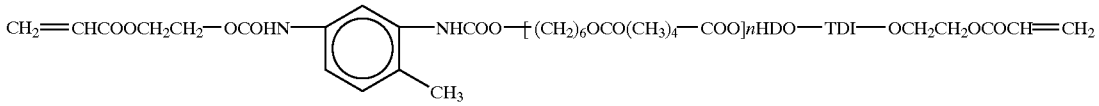

wherein n is an integer of from 1 to 10.

Epoxy acrylate is broadly classified into bisphenol A type, novolak type and alicyclic type when classified by their structure. The epoxy group of these epoxy resins is esterificated with acrylic acid in order that that the functional group is changed into an acryloyl group. Specific examples of the structure are shown in (e)–(g).

(e) Bisphenol A-epichlorohydrin type/acrylic acid compounds

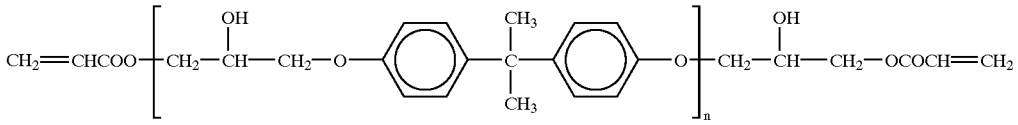

wherein n is an integer of from 1 to 15.

(f) Phenol novolak-epichlorohydrin type/acrylic acid compounds

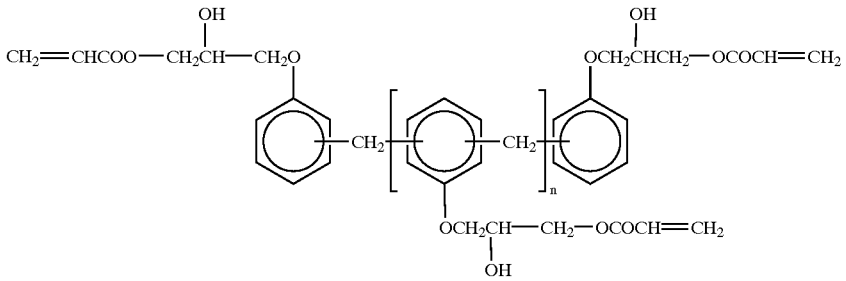

wherein n is 0 or an integer of from 1 to 5.

(g) Alicyclic type/acrylic acid compounds

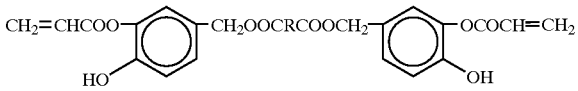

wherein R represents $—(CH_2)_n—$, and n is an integer of from 1 to 10.

Polybutadiene acrylate is a reaction product in which 1,2-polybutadiene having a hydroxy group at its end positions is reacted with an isocyanate, 1,2-mercaptoethanol or the like, and is then further reacted with acrylic acid and the like. An example of the structure is shown in (h).

(h) Polybutadiene/TDI/acrylic acid compounds

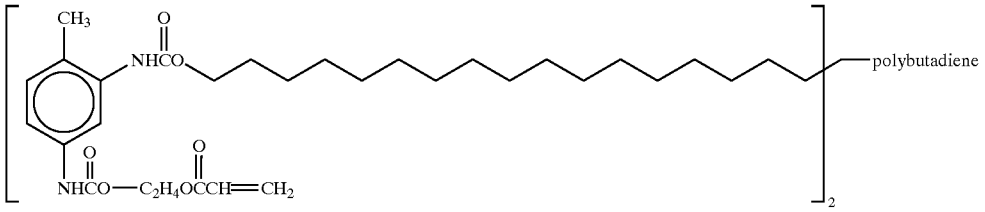

Silicone acrylate is made, for example, by modifying with methacrylic acid a product which is made by condensation reaction (demethanolization reaction) of an organic functional trimethoxy silane with a polysiloxane having a silanol group. An example of the structure is shown in (i).

(i) Trimethoxy silane/polysiloxane/methacrylic acid compounds

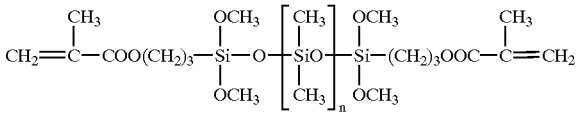

wherein n is an integer of from 10 to 14.

When ultraviolet crosslinking resins are used, a solvent is optionally used. Specific examples of such a solvent include tetrahydrofuran, methyl ethyl ketone, methyl isophenyl isocyanate and the like. In addition, compounds having an acrylic type double bond, 2-hydroxyethyl (meth)acrylate, 2-hydroxypropyl (meth)acrylate, 3-hydroxypropyl (meth) acrylate, and the like can be used as a solvent. As polyester diols which are commercially available, Adeka New Ace Y4–30 (manufactured by Asahi Denka Kogyo) is exemplified. As polyether triols which are commercially available, Sannics TP-400, and Sannics GP-3000 (manufactured by Sanyo Chemical Industries Ltd.) are exemplified.

The molecular weight of the polyester part in the electron beam crosslinking acryl-modified polyurethane resins is preferably from 2000 to 4000 in order to obtain flexibility and toughness, which are requisite for the heat-resistant overcoat layer. The total molecular weight of the electron beam crosslinking acryl-modified polyurethane resins is preferably from 20000 to 50000 for the same reason mentioned above. In the resins, by using acryl-modified polyurethane resins having not less than 5 functional groups, and preferably from 7 to 13 functional groups, crosslinking can be accelerated and hardness of the resultant layer can be enhanced.

Silicone modified electron beam crosslinking resins are resins having the following formula:

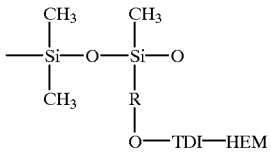

wherein R represents $—(CH_2)_n—$, wherein n is 0 or an integer of from 1 to 3; TDI represents 2,4-tolylenediisocyanate; HEM represents 2-hydroxyethyl acrylate; x is an integer of from 50 to 100; and y is an integer of from 3 to 6.)

These electron beam crosslinking silicone modified resins have good film forming properties, and therefore a uniform thin layer can be formed. In addition, since the resins have a silicone functional group, the resultant layer has good slipping properties.

When an electron beam crosslinking acryl-modified polyurethane resin and an electron beam crosslinking silicone-modified resin are used in combination, the electron beam crosslinking silicone-modified resin is used in an amount of not greater than 30 parts by weight, and preferably from 5 to 20 parts by weight, per 100 parts by weight of the electron beam crosslinking acryl-modified polyurethane resin.

In the present invention, an electron beam crosslinking monomer having plural functional groups is preferably combined in the overcoat layer to promote crosslinking during the formation of the layer and to enhance the heat resistance properties of the layer. Since this monomer serves as a crosslinking promotor, an advantage such that a complex and high-density crosslinked structure can be formed can be obtained.

Specific examples of such a monomer include trimethylolpropane triacrylate, tetramethylolmetane tetraacrylate, pentaerythritol triacrylate, dipentaerythritol triacrylate and the like.

The monomer is added in an amount of not greater than 50 parts by weight, and preferably from 20 to 50 parts by weight, per 100 parts by weight of the electron beam crosslinking acryl-modified polyurethane resin. When the addition amount is greater than 50 parts by weight, lubricating effects weaken, resulting in deterioration of slipping properties.

Another embodiment of the overcoat layer of the present invention is a layer made by a phosphazene type resin having a phosphazene skeleton represented by the following formula as a repeating unit.

$$—(P=N)—$$

The overcoat layer including such a phosphazene resin has excellent heat resistance.

Specific examples of such a resin include resins having the following formula, but are not limited thereto.

$$—[NP(A)_a(B)_b]_n—$$

wherein a and b are an integer satisfying the following equations:

$$a>0, b\geqq 0 \text{ and } a+b=2;$$

A represents a polymerizing crosslinkable group such as methacryloyloxyethyl group and the like; and B represents a group having the following formula:

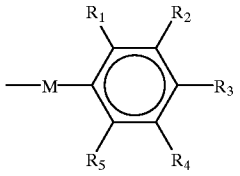

wherein R1–R5 independently represent a hydrogen atom, a chlorine atom, a bromine atom, or a halogenated alkyl group having from 1 to 4 carbon atoms; and M represents an oxygen atom, a sulfur atom or an imino group.

When, for example, A is a methacryloyloxyethyl group and b is 0 in the phosphazene resins having the formula mentioned above, the phosphazene resin can be manufactured by ring-opening polymerization of a compound having the following formula.

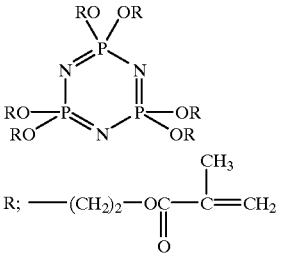

When the resin included in the overcoat layer has a polymerizing crosslinkable group such as the phosphazene type resins represented by the above-mentioned formula, the mechanical strength, hardness and heat resistance of the overcoat layer can be further enhanced by crosslinking the resin upon application of ultraviolet rays, electron beams, heat and the like.

In addition, in order to impart lubricating properties to the overcoat layer, resins to which a silicone segment is connected like a block or a graft are used. Since a silicone segment is connected like a block or a graft, the resultant overcoat layer has lubricating properties against thermal heads. In addition, since a silicone is copolymerized with the resin, dust tends not to adhere to thermal heads.

Specific examples of the silicone segments copolymerized with the resin include organopolysiloxanes which have a siloxane bond and an alkyl group such as a methyl group connected to a silicon atom and which includes a reactive functional group, such as a hydroxy group, a carboxyl group, an epoxy group, an amino group, a mercapto group and the like, at the end position of the molecule or in the molecule of the organopolysiloxanes.

Specific examples of the resins, to which these silicone segments are connected like a block or a graft, include thermoplastic resins such as poly(meth)acrylic acid ester resins, polyvinyl butyral resins, polyvinyl acetoacetal resins, ethyl cellulose, methyl cellulose, acetyl cellulose, hydroxyethyl cellulose, cellulose acetate propionate, polyurethane resins, polyester resins, polyvinyl acetate resins, styrene-acrylate resins, polyolefin resins, polystyrene resins, polyvinyl chloride type resins, polyether resins, polyamide resins, polycarbonate resins, polyethylene resins, polypropylene resins, polyacrylamide resins and the like. Among these resins, poly (meth) acrylic acid ester resins, polyvinyl butyral resins, polyvinylacetoacetal resins, cellulose acetate propionate, ethyl cellulose and polyurethane resins are preferable because of having good heat resistance and being soluble to solvents.

The content of the silicone segment in the silicone-modified resins is preferably from 1 to 30% by weight to maintain good lubricating properties, which results in prevention of a sticking problem, and good binding properties and adhesion properties, which results in prevention of dust-adhesion on thermal heads. In addition, since these silicone-modified resins themselves have a good binding ability, the resins can be used alone or as a main component in the overcoat layer.

Photostabilizers can also be included in the overcoat layer of the present invention similarly to the thermosensitive recording layer to improve the light resistance of the overcoat layer. The photostabilizers for use in the present invention include ultraviolet absorbents, antioxidants, anti-aging agents, quenchers for oxygen in a singlet state, and quenchers for superoxide anions. The same materials as those for use in the above-mentioned thermosensitive recording layer can also be used in the overcoat layer.

The thermosensitive recording material of the present invention can be manufactured by coating a thermosensitive recording layer coating liquid on one side or both sides of a transparent substrate and drying the liquid to form a thermosensitive recording layer, and then forming thereon an overcoat layer including a resin as a main component to form an overcoat layer. The thermosensitive recording layer coating liquid can be prepared by any one of the following methods:

(1) at first only a color developer is uniformly dispersed in an organic solvent, and then a coloring agent and a binder resin are uniformly mixed therewith one by one;

(2) a color developer is uniformly dispersed in a binder resin solution prepared by dissolving the binder resin in an organic solvent, and then a coloring agent and the like are uniformly mixed therewith; and (3) a coloring agent and a color developer are uniformly dispersed in an organic solvent together with a binder resin.

Specific examples of the organic solvent useful for dissolving the binder resins include ethers such as dibutyl ether, isopropyl ether, dioxane, tetrahydrofuran and the like; ketones such as acetone, diethyl ketone, methyl ethyl ketone, methyl isobutyl ketone, methyl propyl ketone and the like; esters such as ethyl acetate, isopropyl acetate, n-propyl acetate, n-butyl acetate and the like; and aromatic hydrocarbons such as benzene, toluene, xylene and the like. These solvents are used alone or in combination.

The method for coating the overcoat layer and coating weight thereof are not particularly limited. However, it is preferable that the overcoat layer is formed by coating a coating liquid with a high-precision wire bar coating machine which uses a wire bare having little eccentricity. The difference in thickness between the right side and left side of the overcoat layer is preferably not greater than 1.0 $\mu$m. In addition, when the performance of the resultant overcoat layer and economics are taken into consideration, the average coating weight is preferably from 1 to 20 $\mu$m in coating thickness, and more preferably from 1 to 10 $\mu$m, to maintain good performance of the overcoat layer as a protective layer, and good performance of the resultant recording material.

In the present invention, the overcoat layer is preferably formed on the recording material so that the resultant recording material has good dimensional accuracy by improving the head-matching properties of the recording material when a thermal head is used as a heat source.

In addition, an antistatic layer is preferably formed on a backside of the recording material to improve antistatic properties of the recording material.

The antistatic layer is required to have an antistatic ability such that a surface resistivity thereof is not greater than $10^8$ Ù/□. Therefore the materials used for the layer are limited, and it is general to add therein an electroconductive metal oxide. Antistatic agents using an electroconductive metal oxide are generally expensive. However, the electroconductive metal oxides have good antistatic ability even when the coating weight is relatively low because the metal oxide itself has an electroconductive property. In addition, since the coating weight is relatively low, the electroconductive metal oxides hardly deteriorate the transparency of the recording material.

Specific examples of the electroconductive metal oxides include $SnO_2$, $In_2O_3$, ZnO, $TiO_2$, MgO, $Al_2O_3$, BaO, $MoO_3$ and the like, which are used alone, and complex oxides in which these metal oxides are mixed with P, Sb, Sn, Zn and the like, but are not limited thereto. It is preferable for these particulate metal oxides to be as fine as possible, because the finer the metal oxides becomes, the better the transparency of the resultant layer. In the present invention, good transparency can be obtained by imparting the average particle diameter of not greater than 0.2 μm to the antistatic agent (metal oxide).

Specific examples of the binder resins for use in combination with these antistatic agents include, for example, water-soluble resins, aqueous emulsions, hydrophobic resins, ultraviolet light crosslinking resins and electron beam crosslinking resins. Specific examples of the water-soluble resins include, for example, polyvinyl alcohols, cellulose derivatives, casein, gelatin, styrene-maleic anhydride, carboxy-modified polyethylene resins and the like. Specific examples of the aqueous emulsions and the hydrophobic resins include, for example, polyvinyl acetate, polyurethane, vinyl chloride/vinyl acetate copolymers, polyesters, polybutyl acrylate, polyvinyl butyral, polyvinyl acetal, ethylene/vinyl acetate copolymers and the like. These are used alone or in combination, and if necessary a hardener may be added therein to crosslink the resins.

Suitable ultraviolet crosslinking resins for use in the antistatic layer include any known monomers, oligomers or prepolymers, which crosslink while inducing a polymerizing reaction upon application of ultraviolet rays. Electron beam crosslinking resins for use in the antistatic layer are also not particularly limited to specific resins, but resins including as a main component an electron beam crosslinking resin having a branched molecular structure having 5 or more functional groups and a polyester skeleton are especially preferable as the electron beam crosslinking resin in the present invention.

With respect to the ratio of the metal oxide to the binder resin, the addition amount of the metal oxide is from 0.05 to 1 part by weight, and preferably from 0.2 to 0.8 parts by weight, per 1 part by weight of the binder resin.

Images are recorded in the transparent thermosensitive recording material of the present invention using a thermal pen, a thermal head, laser heating, thermal etching using light, and the like, which depend on the use of the images. However, in practice, it is preferable to form images using a thermal head.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were dispersed in a bead mill such that the average particle diameter of the octadecyl phosphonic acid was 0.3 μm, to prepare a recording layer coating liquid.

| Recording layer coating liquid | |
|---|---|
| 2-(2'chloroanilino)-6-ethylamino-7-methylfluoran | 10 |
| Octadecyl phosphonic acid | 30 |
| Polyvinyl butyral (Denka Butyral#3000-2 manufactured by Denki Kagaku Kogyo K.K., refractive index of 1.49) | 15 |
| Toluene/methyl ethyl ketone (1/1) mixture | 285 |

The following components were uniformly dispersed such that the average particle diameter of the solid components was about 0.4 μm, to prepare liquids A and B.

| Overcoat layer coating liquid | |
|---|---|
| Liquid A | |
| Kaolin (UW-90 manufactured by Engelhard Corp.) | 10 |
| Silicone modified polyvinyl butyral resin (SP-712 manufactured by Dainichiseika Color & Chemical Mfg. Co., Ltd., solid content of 12.5%) | 8 |
| Methyl ethyl ketone | 12.5 |
| Liquid B | |
| Zinc stearate | 3.3 |
| Silicone modified polyvinyl butyral resin (SP-712 manufactured by Dainichiseika Color & Chemical Mfg. Co., Ltd., solid content of 12.5%) | 2.6 |
| Methyl ethyl ketone | 4.1 |

The following components were mixed to prepare a liquid C. Then liquids A, B and C were mixed to prepare an overcoat layer coating liquid.

| Liquid C | |
|---|---|
| Silicone modified polyvinyl butyral resin (SP-712 manufactured by Dainichiseika Color & Chemical Mfg. Co., Ltd., solid content of 12.5%) | 80 |
| Urethane acrylate type ultraviolet crosslinking resin solution (refractive index of 1.56, Unidic V9057 manufactured by Dainippon Ink and Chemicals Inc., solid content of 75%) | 20 |
| Particulate silicone resin (Tospearl 130 manufactured by Toshiba Silicone Co., Ltd., average particle diameter of 3 μm,) | 15 |
| Silicone oil (X22-161AS manufactured by Sin-Etsu Chemical Co., Ltd.) | 1.5 |
| Polyisocyanate compound (Coronate HL manufactured by Nippon Polyurethane Industry Co., Ltd.) | 11.5 |
| Toluene/methyl ethyl ketone (1/1) mixture | 200 |

The following components were mixed to prepare an antistatic layer coating liquid.

| Antistatic layer coating liquid | |
|---|---|
| $SnO_2$—Sb/polyester emulsion dispersion (Colcoat SP-2002 manufactured by Colcoat Co., Ltd.) | 10 |
| Methanol/water (1/2) mixture | 90 |

Preparation of thermosensitive recording material

The antistatic layer coating liquid was coated with a wire bar on one side of a roll-shaped polyester film having a thickness of 75 μm, Merinex 705 manufactured by E.I. Du Pont de Nemours and Co., in which a variation (R) of thickness in the lateral direction was 2.0 μm and a difference in thickness between the left side and the right side in the lateral direction was 0.1 μm, and dried to form an antistatic layer having a thickness of 0.3 μm.

On the other side of the polyester film the recording layer coating liquid was coated by a high-precision rip coating machine, and dried to form a thermosensitive recording layer having a thickness of about 13.5 μm. In addition, an overcoat layer coating liquid was coated on the recording layer by a high-precision wire bar coating machine and dried, and an ultraviolet lamp irradiated the coated overcoat layer with ultraviolet light of 80 W/cm to form a crosslinked overcoat layer having a thickness of about 3.0 μm.

Thus, a thermosensitive recording material of Example 1 was prepared. The variation (R) of thickness of the thermosensitive recording material in the lateral direction was 2.3 μm and the difference in thickness between the left side and the right side in the lateral direction was 0.3 μm.

Example 2

The procedure performed in Example 1 was repeated except that a polyester film, Merinex 705 manufactured by E.I. Du Pont de Nemours and Co., which had a thickness of 75 μm and in which a variation (R) of thickness in the lateral direction was 3.2 μm and a difference in thickness of the left side and the right side in the lateral direction was 0.9 μm, was used.

The variation (R) of thickness of the resultant thermosensitive recording material in the lateral direction was 2.9 μm and the difference in thickness between the left side and the right side in the lateral direction was 0.1 μm.

Example 3

The procedure performed in Example 1 was repeated except that a polyester film, Merinex 705 manufactured by E.I. Du Pont de Nemours and Co., which had a thickness of 75 μm and in which a variation (R) of thickness in the lateral direction was 4.2 μm and a difference in thickness of the left side and the right side in the lateral direction was 0.5 μm, was used.

The variation (R) of thickness of the resultant thermosensitive recording material in the lateral direction was 4.4 μm and the difference in thickness between the left side and the right side in the lateral direction was 0.4 μm.

Example 4

The procedure performed in Example 1 was repeated except that a polyester film, Merinex 705 manufactured by E.I. Du Pont de Nemours and Co., which had a thickness of 75 μm and in which a variation (R) of thickness in the lateral direction was 4.4 μm and a difference in thickness of the left side and the right side in the lateral direction was 1.1 μm, was used.

The variation (R) of thickness of the resultant thermosensitive recording material in the lateral direction was 4.5 μm and the difference in thickness between the left side and the right side in the lateral direction was 1.3 μm.

Example 5

The procedure performed in Example 1 was repeated except that a polyester film, Merinex 705 manufactured by E.I. Du Pont de Nemours and Co., which had a thickness of 75 μm and in which a variation (R) of thickness in the lateral direction was 3.4 μm and a difference in thickness of the left side and the right side in the lateral direction was 0.8 μm, was used.

The variation (R) of thickness of the resultant thermosensitive recording material in the lateral direction was 3.6 μm and the difference in thickness between the left side and the right side in the lateral direction was 0.9 μm.

The thermosensitive recording materials prepared in Examples 1 to 5 and the transparent substrate thereof were evaluated as follows:

(1) Variation (R) of thickness in the lateral direction and difference in thickness between the left side and the right side The variation (R) of thickness and difference in thickness of each recording material and its transparent substrate were measured by the method mentioned above using a contact type thickness gauge, Electron Micrometer K351C manufactured by Anritsu Corp.

(2) Inter-plates dimensional accuracy and skew

Images were formed on the thermosensitive recording materials 1 to 5 prepared in the following examples using a large-size plotter for exclusive use as a trace station, TP6910 manufactured by Ricoh Co., Ltd. The method for measuring dimensional feeding accuracy and skew were mentioned above.

The results are shown in Table 1.

TABLE 1

| | PET film | | Thermosensitive recording material | | Feeding accuracy | | |
|---|---|---|---|---|---|---|---|
| Example | Variation of thickness (μm) | Difference in thickness (μm) | Variation of thickness (μm) | Difference in thickness (μm) | Inter-plates accuracy (mm) | Skew (mm) | General evaluation |
| Ex. 1 | 2.0 | 0.1 | 2.3 | 0.3 | 0 | 0.1 | ⊙ |
| Ex. 2 | 3.2 | 0.9 | 2.9 | 1.0 | 0.1 | 0.4 | Δ |
| Ex. 3 | 4.2 | 0.5 | 4.4 | 0.4 | 0.2 | 0.2 | Δ |
| Comp. Ex. 1 | 4.4 | 1.1 | 4.5 | 1.3 | 0.2 | 0.5 | X |
| Comp. Ex. 2 | 3.4 | 0.8 | 3.6 | 0.9 | 0.2 | 0.3 | X |

As can be understood from the detailed and concrete description mentioned above, the thermosensitive recording material of the present invention for a block copy use has high levels of inter-plates accuracy and skew, which are requisite for block copy films used for making plates for flexography, gravure printing, offset printing and screen printing, can be obtained. Therefore the thermosensitive recording material of the present invention is useful as block copies.

This document claims priority and contains subject matter related to Japanese Patent Application No. 11-359875, filed on Dec. 17, 1999, incorporated herein by reference.

Having now fully described the invention, it will be apparent to one of ordinary skill in the art that many changes and modifications can be made thereto without departing from the spirit and scope of the invention as set forth therein.

What is claimed is:

1. For use as a recording material of a block copy sheet for plate-making, a roll-shaped thermosensitive recording material comprising a roll-shaped substrate and a thermosensitive recording layer which comprises an electron donating coloring compound, an electron accepting compound and a binder resin and which is formed overlying the roll-shaped substrate, wherein the thermosensitive recording material has a variation (R) of thickness in the lateral direction of not greater than 3 $\mu$m.

2. The roll-shaped thermosensitive recording material according to claim 1, wherein the substrate is transparent and the thermosensitive recording material further has an overcoat layer, which is formed overlying the thermosensitive recording layer and which comprises a resin, wherein the resin in the overcoat layer has a first refractive index and the binder resin in the thermosensitive recording layer has a second refractive index, and wherein the first and second refractive indexes are substantially the same.

3. The roll-shaped thermosensitive recording material according to claim 2, wherein each of the first and second refractive indexes is in a range of from 1.45 to 1.60.

4. The roll-shaped thermosensitive recording material according to claim 1, wherein the roll-shaped substrate has a variation (R) of thickness in the lateral direction of not greater than 4 $\mu$m.

5. The roll-shaped thermosensitive recording material according to claim 1, wherein the roll-shaped substrate has a difference in thickness between a left side and a right side in the lateral direction of not greater than 0.6 $\mu$m.

6. A block copy sheet for making a plate for flexography, gravure printing, offset printing, and screen printing, comprising a thermosensitive recording material and an image formed in the thermosensitive recording material upon application of heat to the thermosensitive recording material, wherein the thermosensitive recording material is a thermosensitive recording material according to claim 1.

7. A method for preparing a block copy sheet for making a plate for flexography, gravure printing, offset printing and screen printing comprising imagewise heating a thermosensitive recording layer to form an image therein, wherein the thermosensitive recording material is a thermosensitive recording material according to claim 1.

8. The method according to claim 7, wherein the imagewise heating is performed with a thermal head.

9. The roll-shaped thermosensitive recording material according to claim 1, wherein the substrate is transparent.

10. The roll-shaped thermosensitive recording material according to claim 1, wherein the substrate is a plastic film.

11. For use as a recording material of a block copy sheet for plate-making, a roll-shaped thermosensitive recording material comprising a roll-shaped substrate and a thermosensitive recording layer which comprises an electron donating coloring compound, an electron accepting compound and a binder resin and which is formed overlying the roll-shaped substrate, wherein the thermosensitive recording material has a difference in thickness between a left side and a right side in the lateral direction of not greater than 0.7 $\mu$m.

12. The roll-shaped thermosensitive recording material according to claim 11, wherein the substrate is transparent and the thermosensitive recording material further has an overcoat layer, which is formed overlying the thermosensitive recording layer and which comprises a resin, wherein the resin in the overcoat layer has a first refractive index and the binder resin in the thermosensitive recording layer has a second refractive index, and wherein the first and second refractive indexes are substantially the same.

13. The roll-shaped thermosensitive recording material according to claim 12, wherein each of the first and second refractive indexes is in a range of from 1.45 to 1.60.

14. The roll-shaped thermosensitive recording material according to claim 11, wherein the roll-shaped substrate has a variation (R) of thickness in the lateral direction of not greater than 4 $\mu$m.

15. The roll-shaped thermosensitive recording material according to claim 11, wherein the roll-shaped substrate has a difference in thickness between a left side and a right side in the lateral direction of not greater than 0.6 $\mu$m.

16. A block copy sheet for making a plate for flexography, gravure printing, offset printing, and screen printing, comprising a thermosensitive recording material and an image formed in the thermosensitive recording material upon application of heat to the thermosensitive recording material, wherein the thermosensitive recording material is a thermosensitive recording material according to claim 11.

17. A method for preparing a block copy sheet for making a plate for flexography, gravure printing, offset printing and screen printing comprising imagewise heating a thermosensitive recording layer to form an image therein, wherein the thermosensitive recording material is a thermosensitive recording material according to claim 11.

18. The method according to claim 17, wherein the imagewise heating is performed with a thermal head.

19. The roll-shaped thermosensitive recording material according to claim 11, wherein the substrate is transparent.

20. The roll-shaped thermosensitive recording material according to claim 11, wherein the substrate is a plastic film.

* * * * *